United States Patent [19]

Papallo, Jr. et al.

[11] Patent Number: 5,036,303

[45] Date of Patent: Jul. 30, 1991

[54] BELL ALARM ACCESSORY ARRANGEMENT FOR MOLDED CASE CIRCUIT INTERRUPTER

[75] Inventors: Thomas F. Papallo, Jr., Plainville; Roger N. Castonguay, Terryville, both of Conn.

[73] Assignee: General Electric Company, New York, N.Y.

[21] Appl. No.: 518,674

[22] Filed: May 3, 1990

[51] Int. Cl.[5] ..... H01H 9/02

[52] U.S. Cl. ..... 335/17; 335/202

[58] Field of Search ..... 335/17, 131–132, 335/202; 340/638.9

[56] References Cited

U.S. PATENT DOCUMENTS

| | | | |
|---|---|---|---|
| 4,209,761 | 6/1980 | Klein et al. | 335/17 |
| 4,356,368 | 10/1982 | Osika | 335/132 |
| 4,595,812 | 6/1986 | Tamaru et al. | 335/132 |
| 4,736,174 | 4/1988 | Castonguay et al. . | |
| 4,894,631 | 1/1990 | Castonguay et al. . | |
| 4,913,503 | 4/1990 | Castonguay et al. . | |
| 4,939,490 | 7/1990 | Bernier et al. | 335/17 |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit interrupter which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components. One such accessory used with the integrated protection unit is a bell alarm for indicating the status of the circuit interrupter contacts.

9 Claims, 5 Drawing Sheets

BELL ALARM ACCESSORY ARRANGEMENT FOR MOLDED CASE CIRCUIT INTERRUPTER

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. U.S. Pat. No. 4,894,631 describes a molded case circuit breaker containing an actuator-accessory unit which provides a wide variety of circuit protection accessory options. This patent is incorporated herein for purposes of reference and should be reviewed for its description of the state-of-the-art of such circuit breakers and accessory devices.

U.S. Pat. No. 4,913,503 describes a reset mechanism for a lower ampere-rated circuit interrupter usually employed as a "branch" circuit interrupter within industrial power distribution systems downstream from a higher ampere-rated "main" circuit interrupter. When actuator-accessory units are used within the higher-rated circuits, the actuator-accessory units are incapable of providing sufficient force, per se, to overcome the holding force of the powerful operating mechanism springs. Additional tripping force is provided by a supplemental tripping mechanism which interacts with the actuator-accessory unit through a sequential resetting system to insure that the actuator-accessory unit becomes reset before the main operating mechanism is reset.

U.S. patent application (41PR-6785) describes a sequential resetting system that interfaces between the tripping mechanism and the actuator-accessory unit of a higher-rated molded case circuit interrupter to insure that the actuator-accessory unit becomes reset before the main operating mechanism. U.S. patent application (41PR-6800) describes the supplemental tripping mechanism that interacts with the actuator-accessory unit to provide sufficient tripping force to articulate the circuit interrupter operating mechanism. Additional accessory devices, such as the bell alarm described in U.S. patent application Ser. No. 311,794 filed Feb. 17, 1989, are often required with such circuit interrupters containing a sequential resetting system and a supplemental tripping mechanism. All three of these Applications are incorporated herein for purposes of reference. In order to use standard accessory designs over a wide range of circuit interrupter ampere ratings, some means must be provided to operate the accessory devices within both higher as well as lower-rated circuit interrupters.

One purpose of this invention accordingly, is to describe a bell alarm accessory arrangement whereby a prior bell alarm design for lower-rated circuit interrupters can also be used within higher-rated circuit interrupters.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The circuit interrupter operating mechanism interfaces with a sequential resetting system by means of a sequence drive lever rotatably connected with the operating mechanism cradle. A bell alarm interface unit interfaces between the bell alarm in the circuit interrupter cover and the sequential resetting system in the interrupter case to actuate the bell alarm when the circuit interrupter operating mechanism responds to an overcurrent condition to interrupt a protected circuit.

DESCRIPTION OF THE PREFERRED EMBODIMENT

Figure 1:
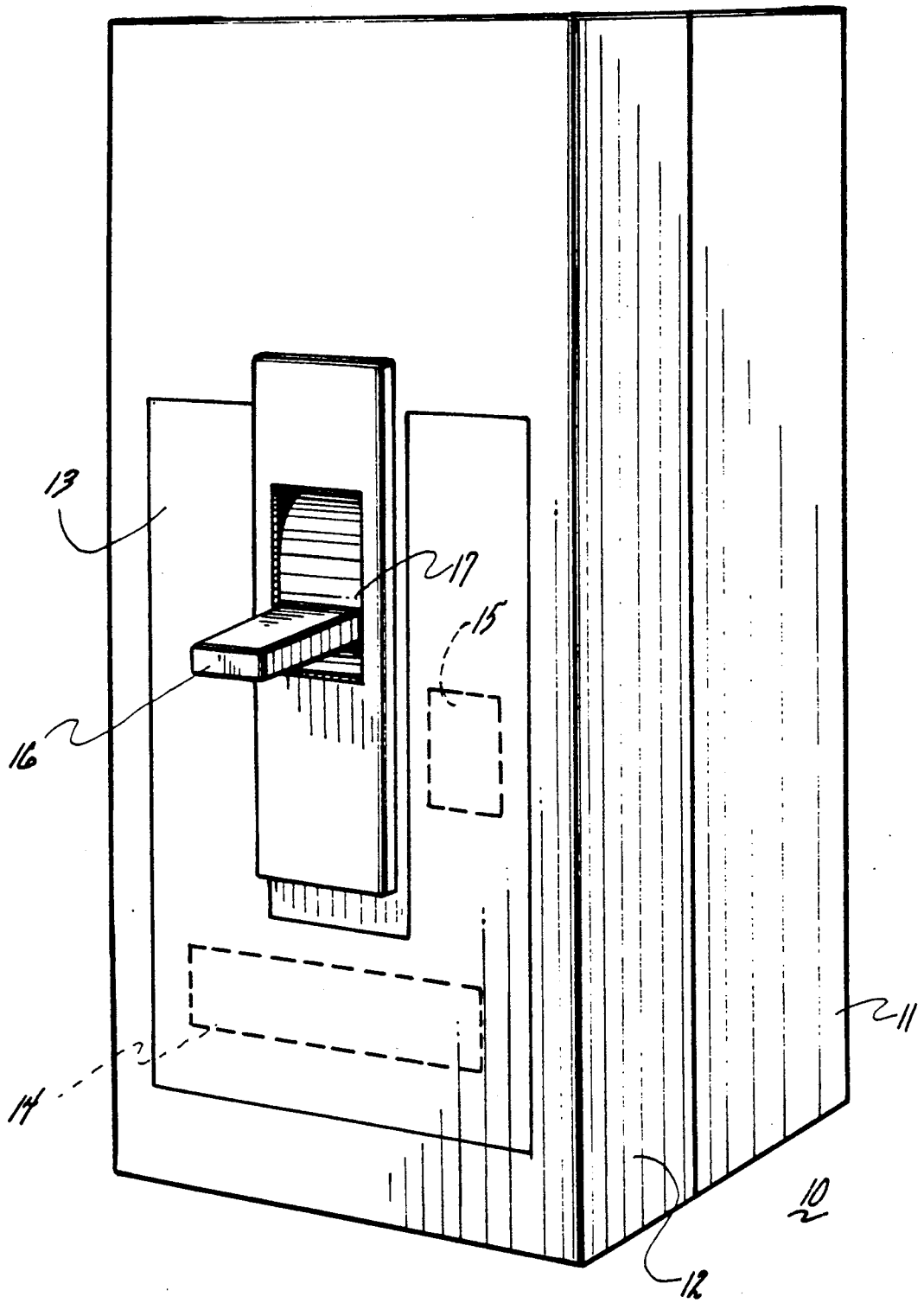
FIG. 1 is a top perspective view of a molded case circuit interrupter containing the bell alarm arrangement in accordance with the invention.

A higher-rated circuit interrupter 10, as described earlier, is depicted in FIG. 1 and consists of a molded plastic case 11 to which a molded plastic cover 12 is fixedly secured. An accessory cover 13 is attached to the circuit interrupter cover and provides access to an electronic trip unit 14 and an actuator-accessory unit 15. An operating handle 16 extends through the circuit interrupter cover by means of an access slot 17 and provides manual intervention to turn the circuit interrupter movable contact 7 at the end of the movable contact arm 6 and the fixed contact 8 on the fixed contact support 9 between their open and closed positions as best seen by referring now to the following FIGS. 2–5.

Figure 2:
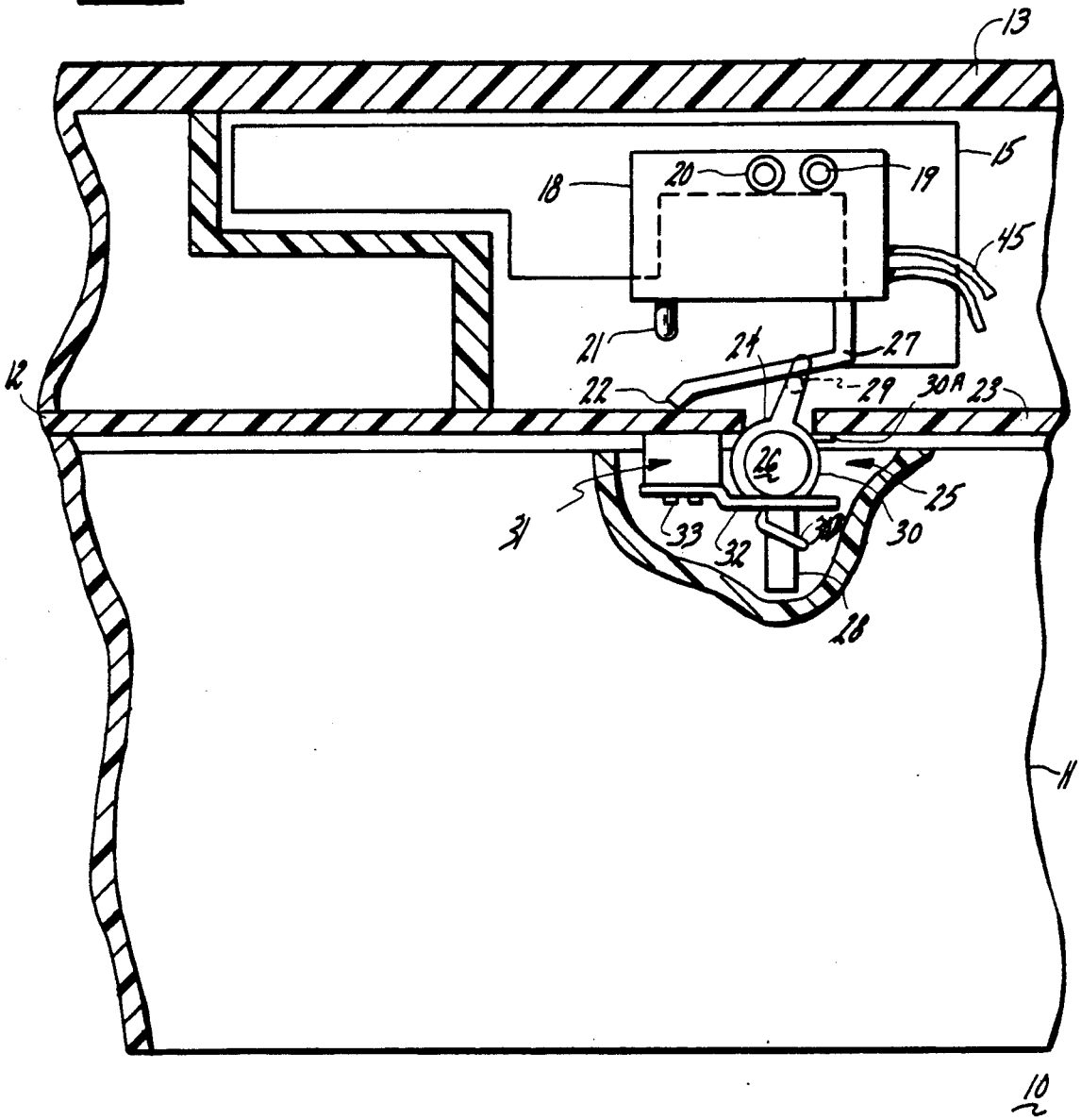
FIG. 2 is an enlarged cutaway side view of the circuit interrupter of FIG. 1 detailing the bell alarm arrangement between the circuit interrupter case and cover.

The bell alarm interface unit 25 is depicted in the circuit interrupter 10 of FIG. 2 arranged between the case 11 and the cover 12. The bell alarm accessory 18 is attached to the actuator-accessory unit 15 by means of a pair of posts 19 extending from the unit and corresponding thru-holes 20 formed through the bell alarm accessory. Access to the bell alarm accessory and the actuator-accessory unit is made through the accessory cover 13. The bell alarm is similar to that described in aforementioned (U.S. patent application Ser. No. 311,794) and includes an actuator button 21 extending from the bottom of the unit and an L-shaped spring 22 which contacts the actuator button 21 to close a microswitch contained within the bell alarm accessory. The bell alarm accessory is connected with a remote bell alarm by means of a pair of wires 45. Upon the occurrence of an overcurrent condition and simultaneous articulation of the circuit interrupter operating mechanism to separate the circuit interrupter contacts, the bell alarm interface unit activates the bell alarm accessory to indicate to a remote operator that such an overcurrent has occurred and that the circuit interrupter has responded to interrupt the circuit current. The bell alarm interface unit 25 is attached to the underside of the bottom 23 of the circuit interrupter cover 12 by attaching a bracket 32 to a projection 31 formed within the circuit interrupter cover by means of screws 33. An upwardly-extending bell lever 27 projects through a slot 24 through the bottom of the cover and interacts with the bell alarm accessory by means of a post 29 which strikes the bell alarm spring 22 driving it into contact with the actuator button 21. The downwardly projecting resetting lever 28 interfaces with the circuit interrupter sequential resetting system in a manner to be described below. The cylindrical body member 26 from which the bell alarm lever 27 and resetting lever 28 extend is trapped between the bottom 23 of the cover and the bracket 32 and is arranged to rotate against the return bias provided by the circumferential torsion spring 30. The spring is trapped against the downwardly projecting resetting lever 28 by means of one end 30B and is captured beneath the bottom 23 of the cover 12 by means of an opposite end 30A. When the bell alarm interface unit 25 is moved from its rest position shown in FIG. 2 to its activated position shown in FIG. 3, the unit returns to its rest position only after the circuit interrupter operating mechanism has been reset to thereby indicate to the remote operator that the protected electrical distribution circuit has again become operational.

Figure 3:
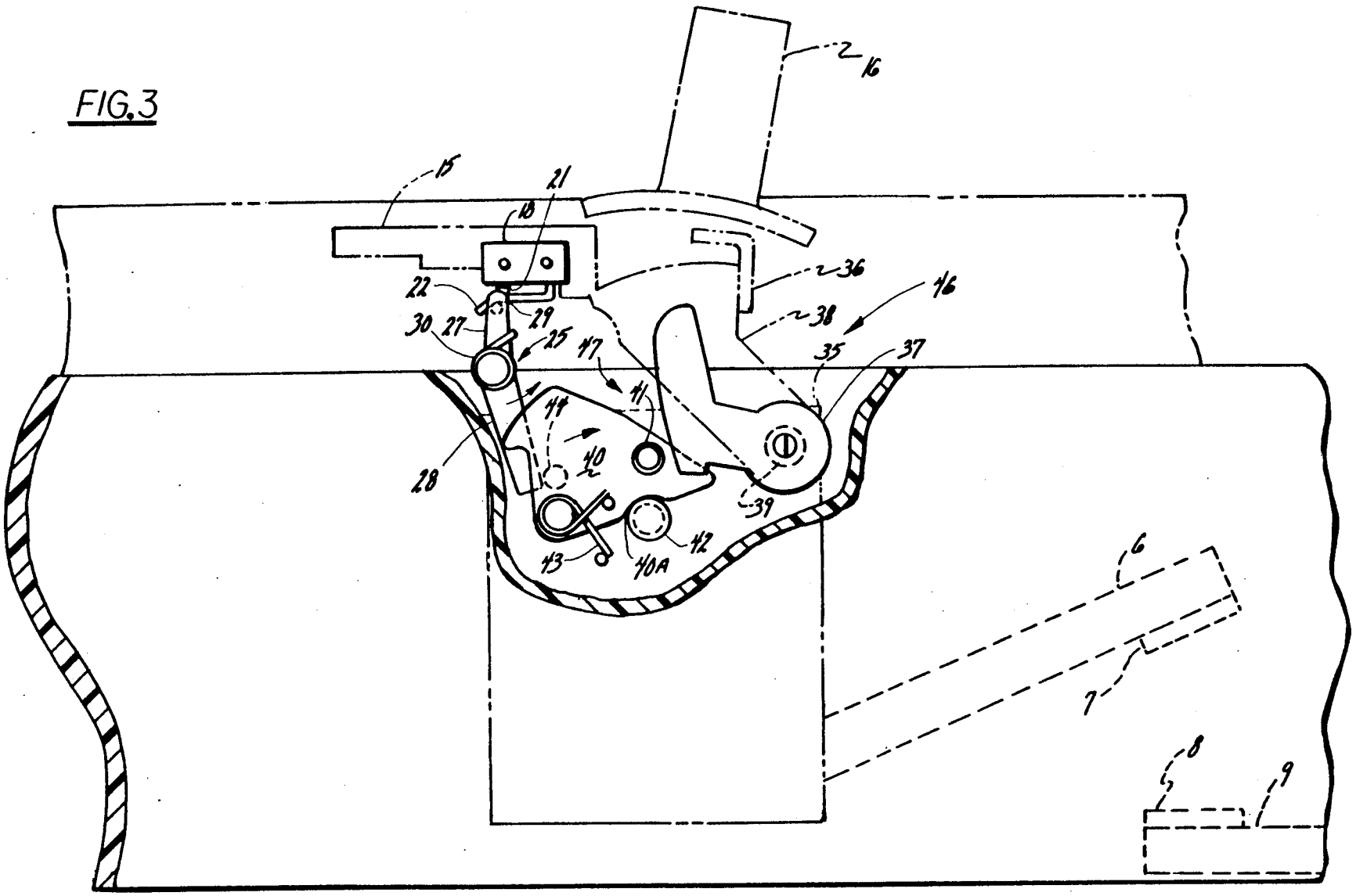
FIG. 3 is a cutaway side view of the circuit interrupter of FIG. 1 with the operating mechanism in a TRIPPED condition.

In the activated position shown in FIG. 3 the operating handle 16 is in a TRIPPED condition such that the operating mechanism generally depicted at 46 has rotated the handle yoke 36 and operating mechanism cradle 38 which allows the movable contact arm 6 to rotate to its OPEN position and thereby separate the movable contact 7 from the fixed contact 8 to interrupt the circuit current. The operating mechanism is described within U.S. Pat. No. 4,736,174 and should be reviewed for its teaching of the articulation of the operating mechanism to separate the interrupter contacts upon occurrence of an overcurrent condition for a predetermined time delay. It is to be noted that the circuit breaker contacts can be separated by manual intervention of the operating handle 16 and handle yoke 36 to turn the operating mechanism between its closed and open condition without releasing the operating mechanism cradle 38 from its latched condition. The sequential resetting system 47 is disclosed in the aforementioned U.S. patent application (41PR-6785) which describes the operation of a sequence driver 37 that is attached to the cradle pivot 39 on the operating mechanism sideframe 35. It is important to note that the sequence driver 37 only rotates when the circuit breaker operating mechanism cradle rotates and is depicted in FIG. 3 in its TRIPPED position away from the drive roller 41 that is attached to the sequence lever 40. The sequence lever is in its rest position wherein the cutout 40A on the sequence lever abuts against the stop 42 arranged on the operating mechanism sideframe 35. A post 44 extending from the opposite side of the sequence lever interacts with the downwardly projecting resetting lever 28. The torsion spring 30 on the interface unit 25 is arranged to hold the post 29 on the upwardly-extending bell alarm lever 27 into contact with the spring 22 which, in turn, holds the actuator button 21 in the activated position to signal to the remote operator that the bell alarm unit 18 on the actuator-accessory unit 15 is actuated. With the sequence driver 37 away from the drive roller 41, the drive roller is now free to rotate in the indicated clockwise direction under the urgence of the return spring 43 such that the cutout 40A abuts against the stop pin 42.

Figure 4:
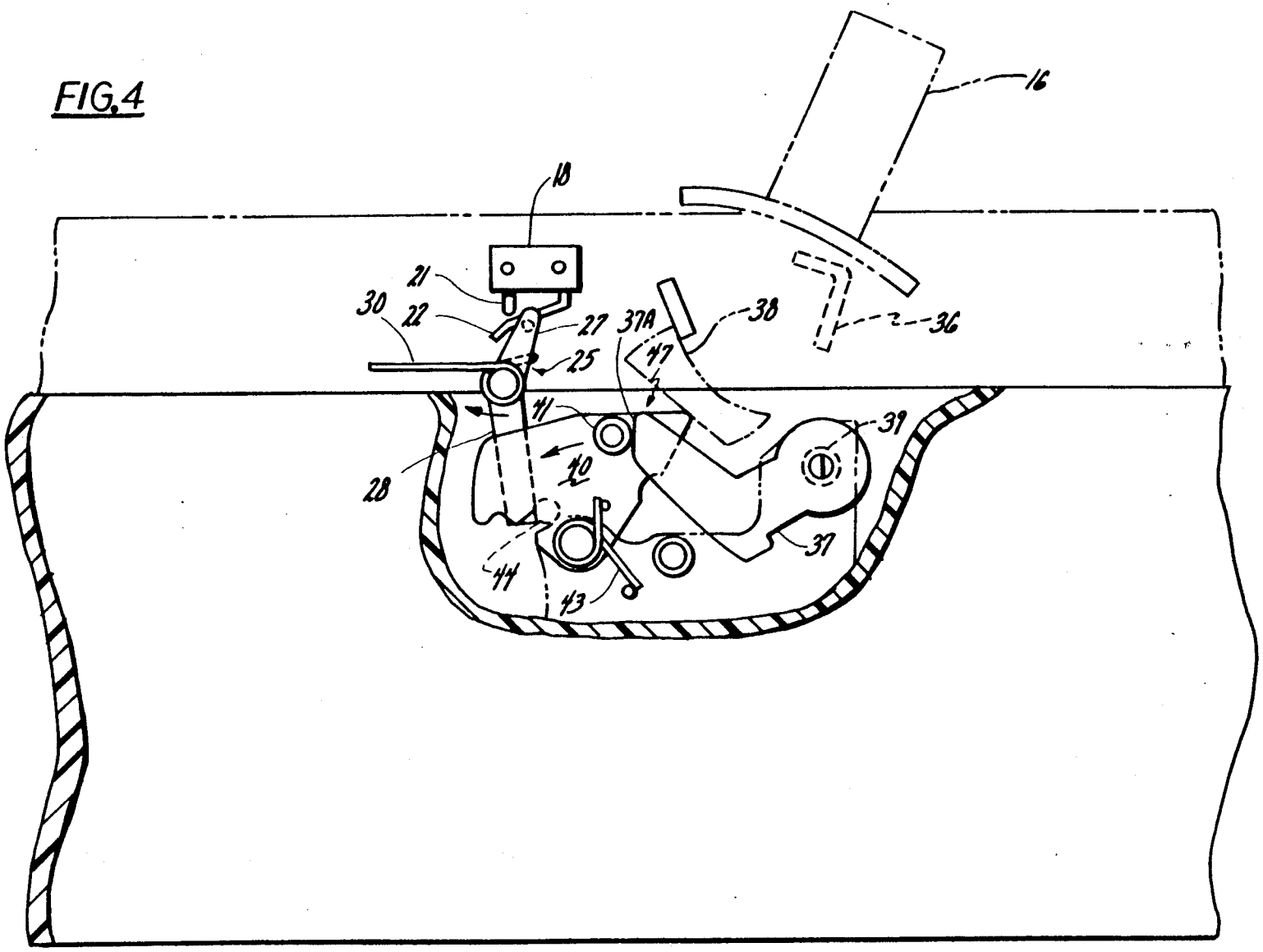
FIG. 4 is a cutaway side view of the circuit interrupter of FIG. 1 with the operating mechanism in a "CLOSED" condition.
Figure 5:
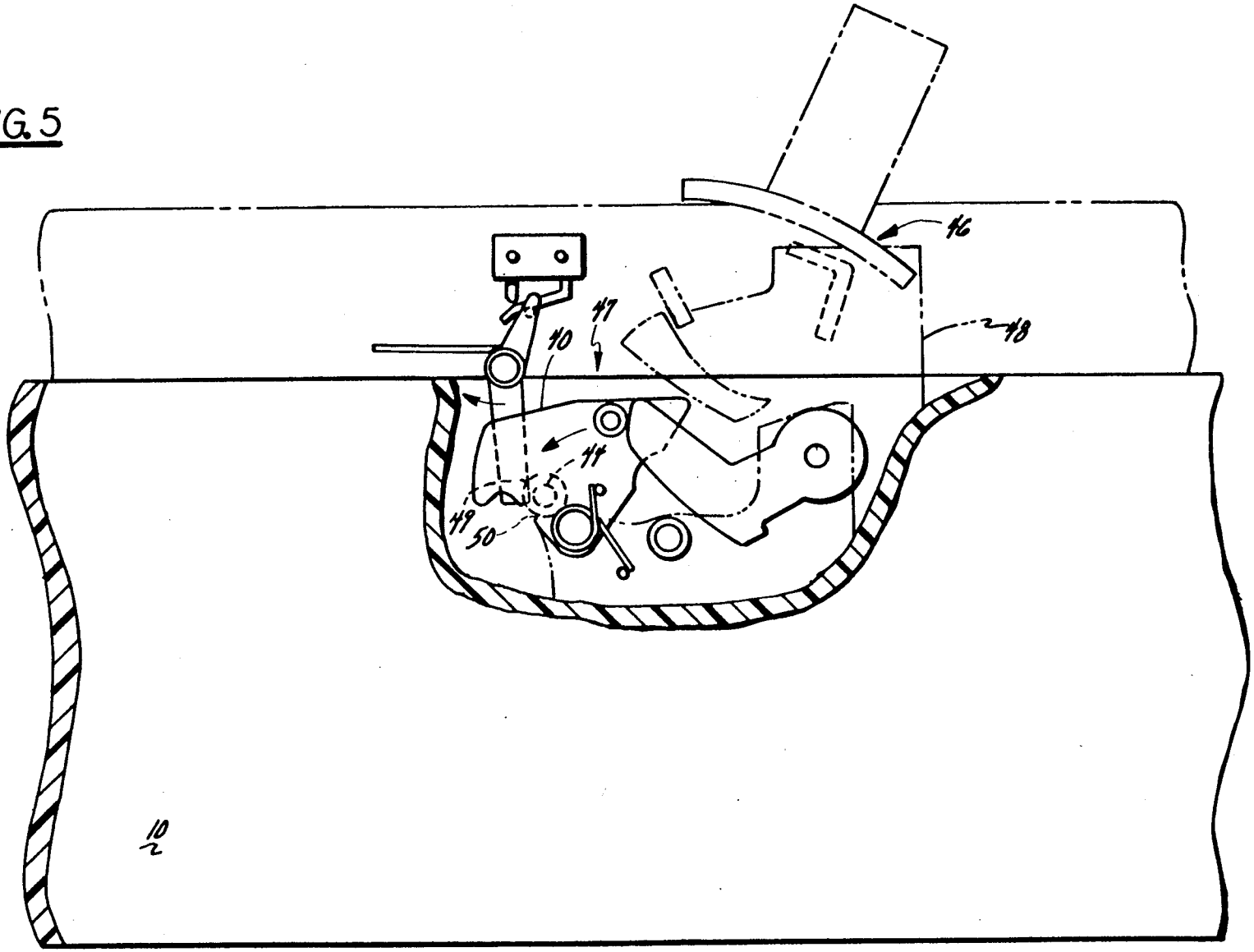
FIG. 5 is a cutaway side view of the circuit interrupter shown in FIG. 4 with an arc shield arranged on the operating mechanism sideframes.

When the operating mechanism is reset, the cradle 38 is latched such that when the operating handle 16 is moved to the CLOSED position shown in FIG. 4, the handle yoke 36 correspondingly moves the movable contact arm and movable contact into the closed position. The prior rotation of the cradle 38 during the resetting of the operating mechanism, forces the cam-shaped end 37A of sequence driver 37 to strike against the drive roller 41 on the sequence lever 40 rotating the sequence lever in the counterclockwise direction against the return bias of spring 43 and thereby driving the post 44 against the downwardly projecting resetting lever 28 rotating the interface unit 25 in the indicated clockwise direction against the return bias of the torsion spring 30 such that the upwardly-extending bell alarm lever 27 thereby allows the spring 22 and actuator button 21 on the bell alarm unit 18 to return to the inactuated position. The connection between the sequence driver 37 and the cradle pivot pin 39 is an important feature of the invention since the operating handle 16 can be moved between its open and closed positions without providing any motion to the component parts of the sequential resetting system 47 thereby substantially decreasing wear of these components. Further, the bell alarm unit 18 does not become operational by rotation of the operating handle 16 and only becomes operational when the cradle 3 releases under an overcurrent condition to allow the operating mechanism to rotate to the trip position shown in FIG. 3 and to provide such indication thereof by activation of the bell alarm unit.

When the circuit interrupter is used within a multiphase circuit, a plurality of circuit breaker compartments are required each including a movable contact arm and fixed and movable contacts. Since each compartment is at a different electrical polarity, it is important to prevent any electrical interaction between the individual compartments. In the circuit interrupter 10 shown in FIG. 5, an insulating shield 48, depicted in phantom, is arranged outboard the circuit interrupter operating mechanism 46 and the sequential resetting system 47. The shield prevents the gaseous by-products, that occur when an arc is created by separation of the circuit interrupter contacts, from contacting and interfering with the movable components used within the sequential resetting system as well as the operating mechanism. The post 44 on the sequential lever 40 extends through a slot 50 within the shield and a separate circular insulating barrier 49 is press-fit over the post to thereby allow the post to move back and forth within the slot while preventing gaseous products from contacting the components used within the sequential resetting system 47 and operating mechanism 46.

Having thus described our invention, what we claim as new and desire to secure by Letters Patent is:

1. A molded case circuit interrupter comprising:

a molded plastic case and cover;

an operating mechanism within said case arranged for automatically separating a pair of contacts upon occurrence of an overcurrent condition within a protected circuit;

a bell alarm accessory within said cover said bell alarm accessory including a flat spring arranged over an actuator button;

a bell alarm interface unit intermediate said bell alarm accessory and said operating mechanism for actuating said bell alarm upon occurrence of said contact separation said interface unit comprising a cylinder rotatably attached to a bottom of said cover;

a resetting system in said case intermediate said operating mechanism and said interface unit for resetting said bell alarm to an unactuated condition;

a downwardly-extending level attached to said cylinder proximate said resetting system;

said resetting system including a reset lever arranged for rotating about a fixed pivot; and a driver level attached to a movable pivot on said operating mechanism whereby said driver level rotates in unison with said operating mechanism.

2. The circuit interrupter of claim 1 including an upwardly-extending lever attached to said cylinder proximate said bell alarm accessory.

3. The circuit interrupter of claim 1 wherein said cylinder is attached to said bottom by means of a bracket.

4. The circuit interrupter of claim 2 wherein said upwardly-extending lever includes an interface post in-line with said flat spring and arranged for striking said flat spring upon rotation of said cylinder.

5. The circuit interrupter of claim 1 including a drive roller on said reset lever arranged for receiving said driver lever and rotating in unison with said driver lever.

6. The circuit interrupter of claim 5 including a reset post extending from said reset lever in-line with said downwardly-extending lever.

7. The circuit interrupter of claim 6 whereby rotating said reset lever and said reset post in a first direction strikes said downwardly-extending lever and rotates said cylinder in an opposite direction to thereby move said upwardly-extending lever away from said flat spring to thereby allow said bell alarm accessory to return to an unactuated condition.

8. The circuit interrupter of claim 7 whereby rotating said reset lever and said reset post in said opposite direction moves said reset post away from said downwardly-extending lever and allows rotation of said upwardly-extending lever in said first direction to contact said flat spring and actuate said bell alarm accessory.

9. The circuit interrupter of claim 8 whereby said downwardly-extending lever rotates under return bias provided by a circumferential torsion spring.

* * * * *